United States Patent [19]

Maurer et al.

[11] Patent Number: 4,543,868

[45] Date of Patent: Oct. 1, 1985

[54] DEVICE FOR HOLDING AND ADVANCING THE STOCK TO BE SLICED ON A COLD MEAT SLICING MACHINE

[75] Inventors: Albrecht Maurer; Karl Frey, both of Balingen, Fed. Rep. of Germany

[73] Assignee: Bizerba-Werke Wilhelm Kraut GmbH & Co. KG, Fed. Rep. of Germany

[21] Appl. No.: 574,666

[22] Filed: Jan. 27, 1984

[30] Foreign Application Priority Data

Feb. 10, 1983 [DE] Fed. Rep. of Germany ..... 3304612

[51] Int. Cl.[4] ..... B26D 7/06

[52] U.S. Cl. ..... 83/713; 83/721; 83/415; 269/54

[58] Field of Search ..... 83/707, 713–731, 83/409, 412, 414, 415; 269/53–54.5

[56] References Cited

U.S. PATENT DOCUMENTS

| | | | |
|---|---|---|---|
| 1,884,351 | 10/1932 | Streckfuss | 269/54.3 |
| 1,965,967 | 7/1934 | Peddicord | 83/409 |
| 2,126,421 | 8/1938 | Stukart | 269/54.3 |
| 2,848,028 | 8/1958 | Talge | 83/717 |
| 3,561,514 | 2/1971 | Karp | 269/54 |

FOREIGN PATENT DOCUMENTS

| | | | |
|---|---|---|---|
| 408244 | 12/1944 | Italy | 269/54 |

*Primary Examiner*—James M. Meister

*Attorney, Agent, or Firm*—Leydig, Voit & Mayer, Ltd.

[57] ABSTRACT

The invention relates to a device for holding and advancing the stock to be sliced on a cold meat slicing machine. At the free end of a base mounted pivotably on the carriage for the stock to be sliced and slidably displaceable transversely to the direction of displacement of the carriage, there is likewise pivotably mounted a gripper with at least two fingers protruding from its pivot axis, and one curved, pointed needle protruding from each finger. The gripper furthermore comprises a manual lever by means of which the curved needles may be pressed into the stock to be sliced.

3 Claims, 4 Drawing Figures

DEVICE FOR HOLDING AND ADVANCING THE STOCK TO BE SLICED ON A COLD MEAT SLICING MACHINE

The invention relates to a device for holding and advancing the stock to be sliced on a cold meat slicing machine comprising a machine frame, a circular cutter blade driven in a rotating manner, a displaceable carriage for the stock to be sliced, and a base pivotably mounted on the carriage for slidable displacement transversely to the direction of displacement of the carriage and positionable on the stock to be sliced with its free end.

Cold meat slicing machines of this kind serve, above all, the purpose of slicing foodstuffs, particularly meat, sausage, cheese and the like. On known machines, the devices for holding and advancing the stock to be sliced to the circular cutter blade are displaceable in the direction of advance on a guide axis attached to the stock carriage and are pivotable about this guide axis, with a surface facing the stock to be sliced being provided with spikes, teeth, combs or forks which are pressed more or less deeply into the stock to be sliced so as to position the stock to be sliced while it is being advanced.

The disadvantage with these is that the spikes, teeth and the like do not have an adequate fixing effect and/or cause considerable damage to the stock to be sliced, for example, by deformation, particularly in the case of soft stock varieties such as sausage spread.

The object underlying the invention is to design a device of the pertinent kind so as to hold the respective piece of stock, substantially independently of its circumferential and cross-sectional shape, securely and without damaging it.

The object is attained in accordance with the invention in that there is pivotably mounted at the free end of the base a gripper with at least two fingers protruding from its pivot axis, and one curved needle projecting from each of the fingers, and in that the gripper comprises a manual lever with which the curved needles may be pressed into the stock to be sliced.

A preferred embodiment of the invention will now be described more particularly with reference to the attached drawings, in which.

Figure 1:
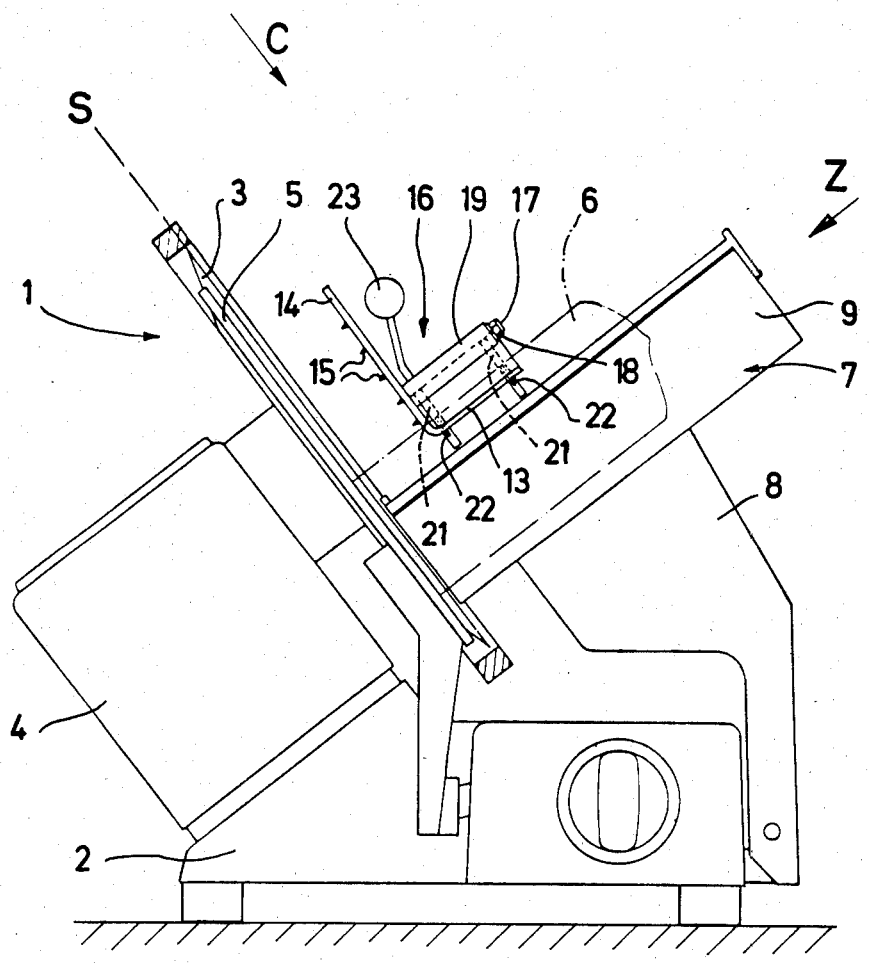
FIG. 1 shows in schematic illustration a front view of a cold meat slicing machine.

The cold meat slicing machine 1 illustrated schematically in the drawings comprises a machine frame 2 with a circular cutter blade 3 rotatably mounted thereon. The circular cutter blade 3 is made to rotate by a motor, not illustrated, which is enclosed by a housing section 4. The cutting plane of the circular cutter blade is designated by S. An adjustable stop plate 5 extending parallel to this plane determines in a known manner the thickness of cut. The stock 6 to be cut into slices (in the drawings a sausage) is placed on the supporting surface 7 of a carriage 8 which is slidably displaceable in a manner known per se parallel to the cutting plane S of the circular cutter blade 3. The stock to be sliced is held against the stop plate 5 and advanced, horizontally on the carriage 8, towards the rotating circular cutter blade 3. After each cutting-off of a slice, the stock to be sliced must be brought forward in the direction of advance Z and brought to rest against the stop plate 5 again.

The cold meat slicing machine illustrated in the drawings is a so-called "oblique cutter" wherein the cutting plane S, the supporting surface 7 of the carriage 8 and, consequently, also the direction of advance Z extend obliquely relative to the horizontal. The device according to the invention for holding and advancing the stock to be sliced, which will be described subsequently, is, however, not only suitable for such machines but also for machines with a vertically arranged circular cutter blade and horizontally positioned supporting surface 7.

Figure 2:
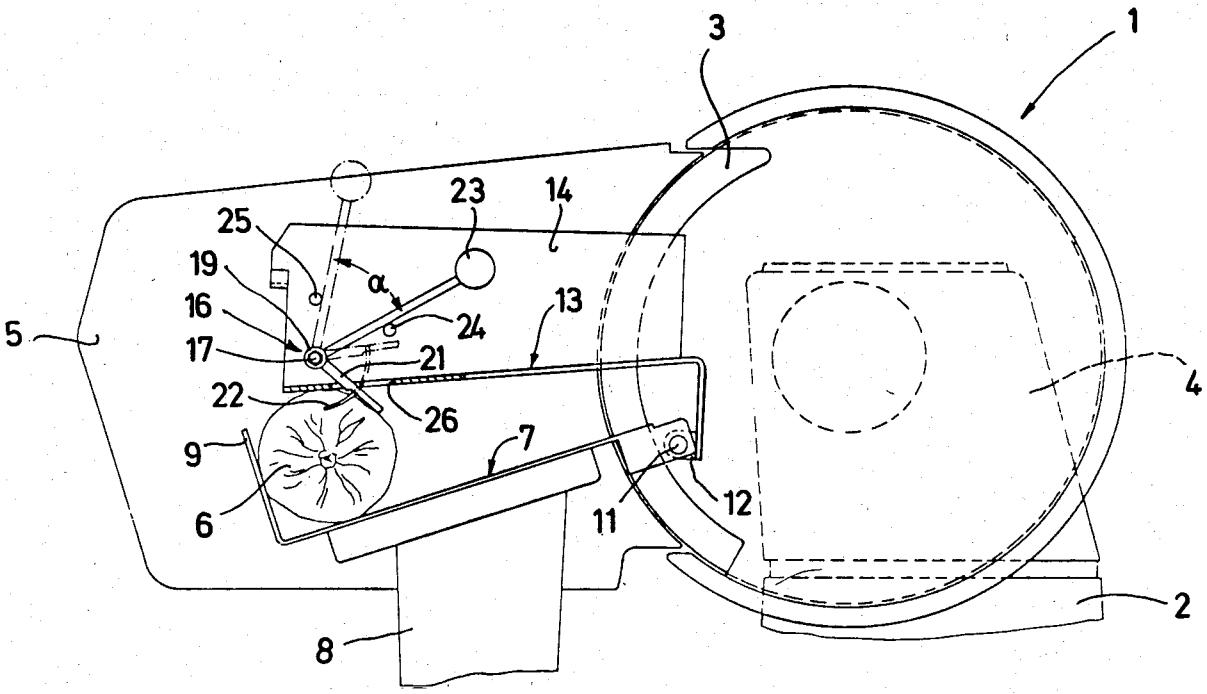
FIG. 2 shows a side view of the machine in the direction of arrow Z in FIG. 1.
Figure 3:
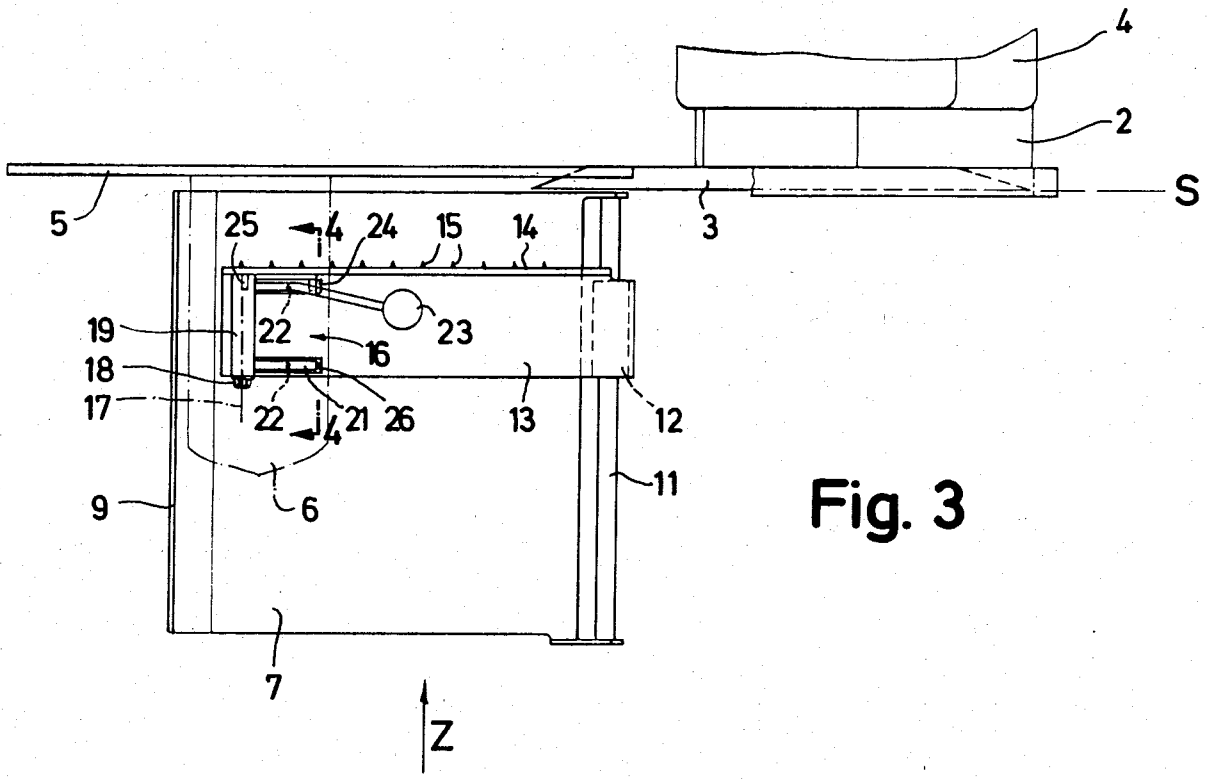
FIG. 3 shows a top view (turned through 90°) in the direction of arrow C in FIG. 1.

The supporting surface 7 extending obliquely towards the front side of the machine, as shown in FIG. 2, comprises at its front side an upwardly bent edge section 9 against which the advanced stock to be sliced 6 also rests (FIG. 2). A guide axis 11 extending parallel to the direction of advance Z is rigidly mounted at the supporting surface 7 on the edge opposite the edge section 9. Mounted on the guide axis 11 by a guide sleeve 12 for pivotable motion (in the plane of FIG. 2) and slidable displacement in the Z direction is a base 13 acting as holding and advancing device. The base 13 is of bent configuration, as shown in FIG. 2, and extends in the form of a swivel bar from the guide axis 11 to the stock to be sliced 6 resting against the edge section 9. The free end of the base 13 may be placed on the circumference of the stock to be sliced in the manner apparent from FIG. 2. From the base 13 extending parallel to the direction of advance Z there protrudes—parallel to the cutting plane S and perpendicularly to the direction of advance Z—a leg 14 of plate-shaped configuration comprising projecting spikes 15 on its side facing the circular cutter blade 3.

Figure 4:
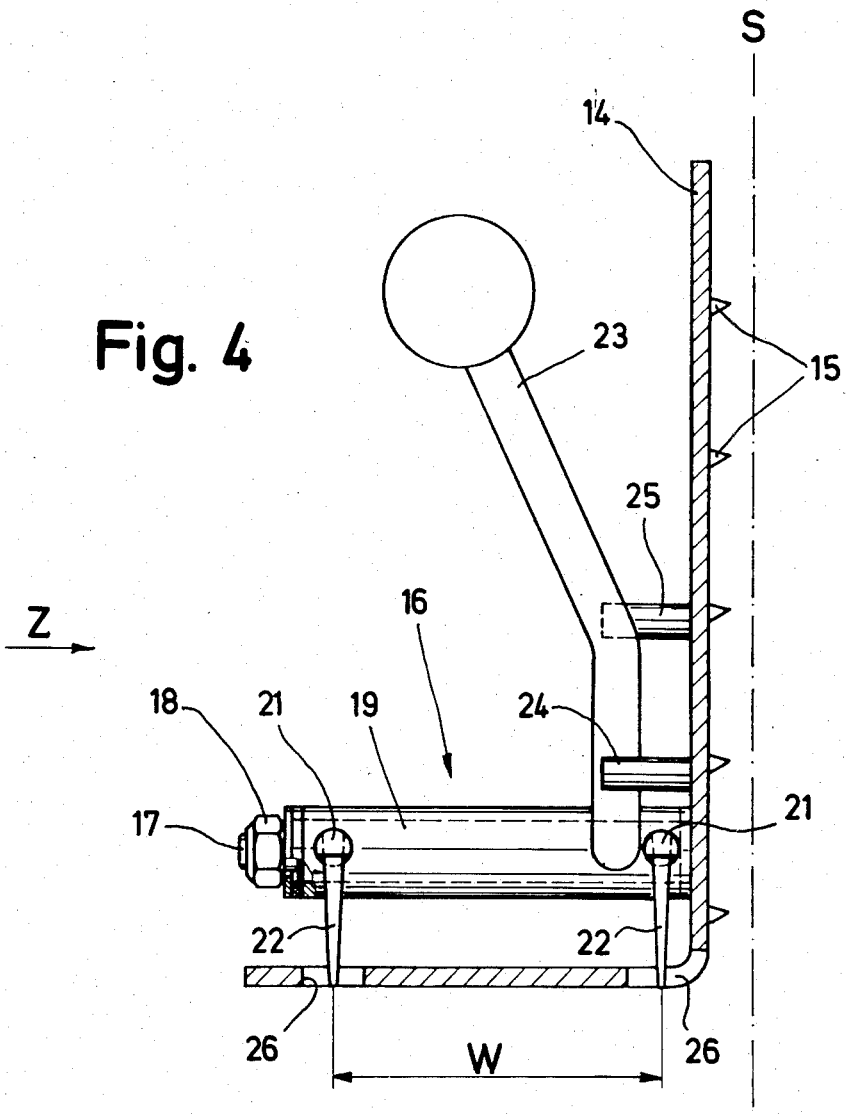
FIG. 4 shows a sectional view along line 4—4 in FIG. 3.

A gripper 16 is mounted at the free end of the base 13 to permit a fixed connection to be provisionally made between the base 13 displaceable in the direction of advance Z and the stock to be sliced 6, so that the stock may be advanced to the circular cutter blade 3 with the aid of the base guided on the guide axis 11. The gripper 16 comprises a pivot axis 17 protruding rigidly from the leg 14, with a sleeve 19 rotatably mounted and secured by a nut 18 on the pivot axis. Two fingers 21 protrude perpendicularly and in mutually spaced relationship W (FIG. 4) from the sleeve 19. Attached at approximately the center of these fingers are likewise projecting, thin, curved needles 22 pointing downwardly towards the stock to be sliced 6. The curvature of the thin needles 22 extends on circles concentric with the pivot axis 17. As illustrated, the pivot axis 17 itself extends parallel to the direction of advance Z. There is, furthermore, rigidly connected to the sleeve 19 a manual lever 23 with whose aid the sleeve 19 and the needles 22 rigidly connected to it may be pivoted to and fro. Two stop members 24, 25, respectively struck by the manual lever 23, delimit the swivel angle $\alpha$.

The plate-shaped base 13 comprises slots 26 parallel to the cutting plane S. The pivot axis 17 of the gripper 16 is located above the base 13. If the gripper 16 is pivoted out of its left position, as illustrated in dot-and-dash lines in FIG. 2, by touching the handle 23, into the position illustrated in unbroken lines, the thin, curved needles 22 then smoothly penetrate the stock to be sliced 6 because they extend in curved configuration concentrically with the pivot axis 17. As is apparent from FIG. 2, the free end areas of the fingers 21 contact tangentially the circumferential surface of the stock to be sliced 6 and thereby delimit the depth to which the needles 22 pierce the stock to be sliced. On account of the relatively large supporting surface of the fingers 21 contacting the stock to be sliced 6, the latter is not deformed or damaged during penetration of the needles. Damage to the stock to be sliced is, furthermore, also prevented by the guidance of the needles on orbital trajectories concentric with the pivot axis 17. The spacing W between the needles 22 ensures secure attachment to the gripper.

In a position removed from the cutting plane S, the gripper is cooperatingly connected with the stock to be sliced via the needles 22. Once the stock to be sliced 6 is fixedly connected with the base 13 by the needles 22 which have penetrated it, the base can be advanced to the circular cutter blade 3, together with the stock to be sliced 6 held firmly at it, during the successive cutting-off of slices.

In other embodiments of the invention, it is also possible to have more than two fingers 21 with needles 22 arranged on the sleeve 19. Furthermore, more than one needle curved concentrically with the pivot axis may be arranged so as to project from each finger.

In order to cut up pieces of leftover stock which are shorter than the distance W between two fingers 21, by having the pieces pierced and held by only one of the pointed needles 22, the short leftover pieces are placed between the circular cutter blade 3 and the leg 14 of the base, with the spikes 15 on leg 14 which are oriented towards the circular cutter blade 3 piercing the rear side of the leftover piece resting against the leg 14 and ensuring that it is entrained once the carriage 8 moves.

We claim:

1. Device for holding and advancing the stock to be sliced on a cold meat slicing machine comprising a machine frame, a circular cutter blade (3) driven in a rotating manner, a displaceable carriage (8) for the stock to be sliced, and a base (13) extending parallel to the direction of advance (Z) of the stock to be sliced towards the circular cutter blade (3) and pivotably mounted on the carriage for slidable displacement transversely to the direction of displacement of the carriage and positionable on the stock to be sliced, characterized in that there is pivotably mounted on the base (13) a gripper (16) having a pivot axis (17) and with at least two fingers (21) protruding from said pivot axis (17), and one curved, pointed needle (22) protruding from each of the fingers, and in that the gripper comprises a manual lever (23) by means of which the needles may be pressed into the stock to be sliced (6), the fingers (21) being arranged in the direction of the pivot axis (17), one behind the other, said needles being curved concentrically with said pivot axis, and said pivot axis extending parallel to said direction of advance (Z); and a leg (14) of plate-shaped configuration, comprising projecting spikes (15) on the side facing the circular cutter blade, protruding from said base (13) and extending parallel to the cutting plane (S) and perpendicularly to the direction of advance (Z).

2. Device for holding and advancing the stock to be sliced on a cold meat slicing machine comprising a machine frame, a circular cutter blade (3) driven in a rotating manner, a displaceable carriage (8) for the stock to be sliced, and a base (13) extending parallel to the direction of advance (Z) of the stock to be sliced towards the circular cutter blade (3) and pivotably mounted on the carriage for slideable displacement transversely to the direction of displacement of the carriage and positionable on the stock to be sliced, characterized in that there is pivotably mounted on the base (13) a gripper (16) having a pivot axis (17) and with at least two fingers (21) protruding from said pivot axis (17), and one curved, pointed needle (22) protruding from each of the fingers, each of such fingers being disposed on the gripper (16) in mutually spaced relationship (W) and parallel to each other, and in that the gripper comprises a manual lever (23) by means of which the needles may be pressed into the stock to be sliced (6), the fingers (21) being arranged in the direction of the pivot axis (17), one behind the other, said needles being curved concentrically with said pivot axis; and a leg (14) of plate-shaped configuration, comprising projecting spikes (15) on the side facing the circular cutter blade, protruding from said base (13) and extending parallel to the cutting plane (S) and perpendicularly to the direction of advance (Z).

3. Device for holding and advancing the stock to be sliced on a cold meat slicing machine comprising a machine frame, a circular cutter blade (3) driven in a rotating manner, a displaceable carriage (8) for the stock to be sliced, and a base (13) extending parallel to the direction of advance (Z) on the stock to be sliced towards the circular cutter blade (3) and pivotably mounted on the carriage for slideable displacement transversely to the direction of displacement of the carriage and positionable on the stock to be sliced, characterized in that there is pivotably mounted on the base (13) a gripper (16) having a pivot axis (17) and with at least two fingers (21) protruding from said pivot axis (17), and one curved, pointed needle (22) protruding from each of the fingers, the pivot range of the gripper (16) being delimited by stop members (24,25), and in that the gripper comprises a manual lever (23) by means of which the needles may be pressed into the stock to be sliced (6), the fingers (21) being arranged in the direction of the pivot axis (17), one behind the other, said needles being curved concentrically with said pivot axis; and a leg (14) of plate-shaped configuration, comprising projecting spikes (15) on the side facing the circular cutter blade, protruding from said base (13) and extending parallel to the cutting plane (S) and perpendicularly to the direction of advance (Z).

* * * * *